US010000962B2

(12) United States Patent
Berger et al.

(10) Patent No.: US 10,000,962 B2
(45) Date of Patent: Jun. 19, 2018

(54) GUIDING DEVICE FOR A SLIDING DOOR

(71) Applicant: EKU AG, Sirnach (CH)

(72) Inventors: Patrick Berger, Bischofszell (CH); Beat Goldinger, Ermatingen (CH)

(73) Assignee: EKU AG, Sirnach (CH)

( * ) Notice: Subject to any disclaimer, the term of this patent is extended or adjusted under 35 U.S.C. 154(b) by 0 days. days.

(21) Appl. No.: 15/138,820

(22) Filed: Apr. 26, 2016

(65) Prior Publication Data

US 2016/0312521 A1 Oct. 27, 2016

(30) Foreign Application Priority Data

Apr. 27, 2015 (EP) ..... 15165292

(51) Int. Cl.

| | |
|---|---|
| ***E05D 15/00*** | (2006.01) |
| ***E06B 3/46*** | (2006.01) |
| ***E05D 15/10*** | (2006.01) |
| ***E05D 15/30*** | (2006.01) |

(52) U.S. Cl.

CPC ..... *E06B 3/4672* (2013.01); *E05D 15/00* (2013.01); *E05D 15/1005* (2013.01); *E05D 15/1042* (2013.01); *E05D 15/30* (2013.01); *E05D 2015/1026* (2013.01); *E05D 2015/1031* (2013.01); *E05D 2015/1034* (2013.01); *E05D 2015/1055* (2013.01); *E05Y 2201/47* (2013.01); *E05Y 2201/64* (2013.01); *E05Y 2900/20* (2013.01)

(58) Field of Classification Search

CPC ... E05B 3/4672; E05D 15/00; E05D 15/0621; E05D 15/063; E05D 15/0634; E05D 15/0652; E05D 15/0686; E05D 15/1005; E05D 15/1042; E05D 15/165; E05D 15/30

USPC ..... 16/87 R, 87.4 R, 90, 91, 95 R, 96 R, 97, 16/106

See application file for complete search history.

(56) References Cited

U.S. PATENT DOCUMENTS 4,152,872 A * 5/1979 Tanizaki ..... E05D 15/1047 16/96 R
4,464,863 A * 8/1984 Chikaraishi ..... B60J 5/062 49/213

(Continued)

FOREIGN PATENT DOCUMENTS

DE 20 2005 004059 U1 5/2005
EP 2 527 575 A2 11/2012

(Continued)

OTHER PUBLICATIONS

Oct. 9, 2015 Search Report issued in European Patent Application No. 15165292.2.

*Primary Examiner* — Roberta S Delisle
(74) *Attorney, Agent, or Firm* — Oliff PLC

(57) ABSTRACT

The guiding device serves for holding and guiding a sliding door, with which a furniture opening of a piece of furniture can be closed. The guiding device comprises a guide fitting that is connectable to the sliding door and that is connected via a first articulated joint to a first end piece of a guide lever, whose second end piece is connected via a second articulated joint to a guide carriage, which comprises a carriage body that holds at least one guide roller, which is guided in a guide channel that extends at least on one side in a terminal channel section along a curve into the furniture opening.

16 Claims, 7 Drawing Sheets

(56) References Cited

U.S. PATENT DOCUMENTS

| | | | | |
|---|---|---|---|---|
| 4,662,109 | A * | 5/1987 | Yui | E05B 83/40 49/214 |
| 5,016,318 | A * | 5/1991 | Harris | E05D 15/0608 16/94 R |
| 7,654,608 | B2 * | 2/2010 | Krajenke | E05D 15/101 296/155 |
| 7,669,367 | B2 * | 3/2010 | Shimura | B60J 5/06 296/155 |
| 8,308,221 | B2 * | 11/2012 | Kitayama | B60J 5/06 16/91 |
| 8,695,165 | B2 * | 4/2014 | Pelekanos | E05D 15/26 16/105 |
| 8,763,205 | B2 | 7/2014 | Schmidhauser et al. | |
| 2004/0098831 | A1 * | 5/2004 | Elmer | E05D 15/063 16/89 |
| 2011/0131767 | A1 * | 6/2011 | Heuel | B60J 5/06 16/96 R |
| 2014/0150208 | A1 | 6/2014 | Haab et al. | |

FOREIGN PATENT DOCUMENTS

| | | | |
|---|---|---|---|
| FR | 2 094 969 | A5 | 2/1972 |
| GB | 738 486 | A | 10/1955 |

* cited by examiner

GUIDING DEVICE FOR A SLIDING DOOR

BACKGROUND

The invention relates to a guiding device for a sliding door, a carriage for such a guiding device as well as to a piece of furniture, particularly a wardrobe, having at least one sliding door that is held and guided by the guiding device.

Sliding doors allow advantageously closing a piece of furniture, particularly a wardrobe. For opening a wardrobe sliding doors are laterally moved and need not be turned, such as revolving doors, into the space towards the user. However, the sliding doors, which are opened, also require space in which they can be parked.

[1], US2014/150208A1, discloses a wardrobe with a guiding device with which sliding doors can be folded and moved parallel to the sidewall of the wardrobe into a parking room. The space required for the parking room within the wardrobe however is no longer available for use.

[2], U.S. Pat. No. 8,763,205 B2, discloses a wardrobe with a plurality of sliding doors that are held and guided each by a carriage device, which is movable along guide rails so that the sliding doors can be offset from a furniture opening and moved aside. The carriage devices comprise carriages and carriage arms that are connected via connecting devices or fittings to the sliding doors. Hence, the sliding doors of this wardrobe are not transported into a dedicated parking space, but are moved in front of a neighbouring sliding door. Hence, at a wardrobe with two sliding doors the user can move one sliding door in front of the other. Hence, the opened sliding door is then located in front of the closed sliding door, exposed to the view of the user. With wardrobes of this kind sliding doors must therefore precisely be aligned and guided, in order to avoid collisions when moving and to create an advantageous appearance when the sliding doors have reached the end position.

Due to the relatively complex guidance of the sliding doors, which are offset from the furniture opening when opened and moved against the furniture opening when closed and shifted in parallel to the wardrobe outside these terminal ranges, the guiding device needs to fulfill several functions which have not been provided satisfactorily by known devices.

Besides precise guidance for avoiding collisions and a desired alignment of the sliding doors, it would be particularly desirable, when the sliding doors could be held and guided more stable, so that vibrations and noise, particularly in the range of the parallel guidance of the sliding doors could be avoided. It would further be desirable that the sliding doors reliably close the furniture opening after the closing procedure, so that open gaps and a remaining play of the sliding doors are avoided. Further, known devices often exhibit the disadvantage that the sliding doors cannot be shifted completely away from the related furniture openings, so that access to the furniture openings is obstructed. Due to the limitation in displacement of the sliding doors a maximum size of the furniture openings can often not be reached.

SUMMARY

The present invention is therefore based on the object of providing an improved guiding device as well as a piece of furniture with at least one sliding door that is advantageously shiftable by means of such a guiding device between an opened position and a closed position. Further, an advantageous carriage for such a guiding device shall be created.

Particularly, a guiding device shall be created, with which a sliding door or generally a plane separation element held therewith can precisely be moved along a transport track, which comprises at least one curve.

The guiding device shall allow in particular increasing the shift range of the wardrobe doors and thereby completely opening a related furniture opening and creating furniture openings with maximum size.

The guiding device shall allow holding a sliding door practically without play and shifting it without creating noise. Further, the sliding door shall be shiftable with the guiding device such that a corresponding furniture opening is reliably closed.

Further, the guiding device shall not have a complex structure and shall not require much space so that the interior space of the wardrobe is available to the user without substantial limitations.

Further, the guiding device shall allow supporting the load of the sliding door fully or partially.

Hence, it shall be possible to create a piece of furniture, particularly a wardrobe that is equipped with the inventive guiding device that can advantageously be dimensioned, operated and used.

This problem solved with a guiding device, a guide carriage and a piece of furniture with at least one such guiding device that comprise the features of claim 1, 11 or 13 respectively. Preferred embodiments of the invention are defined in further claims.

The guiding device serves for holding and guiding a sliding door, with which a furniture opening of a piece of furniture can be closed. The guiding device comprises a guide fitting that is connectable to the sliding door and that is connected via a first articulated joint to a first end piece of a guide lever, whose second end piece is connected via a second articulated joint to a guide carriage, which comprises a carriage body that holds at least one guide roller, which is guided in a guide channel that extends at least on one side in a terminal channel section along a curve into the furniture opening. In preferred embodiments guiding devices holding a sliding door each are provided at both ends of the guide channel.

During the displacement of the sliding door against the furniture opening the guide carriage is driven into the interior space of the wardrobe and the guide lever is turned. During the displacement of the guide carriage in the terminal channel section the sliding door can therefore be guided laterally farther into the end position and at the same time against the furniture opening. Thereby the guide fitting can be guided passed by the guide carriage and against the furniture opening. Hence, the guide fitting is moved farther in closing direction of the sliding door than the guide carriage. When the guide carriage is moved out of the terminal channel section then the guide lever is turned back, so that the guide fitting is guided passed by the guide carriage into the other direction and the guide carriage is following pulled by the guide lever. Hence, also in opening direction of the sliding door the guide fitting traverses a longer path than the guide carriage.

Due to driving the guide carriage along a curve and the turning of the preferably curved guide lever the guiding device allows displacement of the guide fitting and therefore of the sliding door along the front side of the wardrobe over a wider area compared to the displacement of the guide carriage. The furniture opening can therefore be dimensioned with maximum size. Further, each sliding door can fully be offset from the related furniture opening so that the user has unobstructed access into the interior space of the wardrobe. By means of the curved guiding lever the guide fitting can therefore be guided ahead of the guide carriage during the opening process of the sliding door and the furniture opening can completely be opened.

In a preferred embodiment the carriage body of the guide carriage holds two guide rollers arranged behind one another in running direction and is connected in addition by a coupling spring with the second end piece of the guide lever.

The coupling spring is preferably a spiral spring or a cylindrical coil spring, which is held in a recess provided inside of the carriage body and which is anchored with a first end piece in the carriage body and with a second end piece in the guide lever. Preferably, the coupling spring is arranged in a cylindrical recess provided in the carriage body coaxially aligned to a joint bolt, which is held preferably rotatably in the carriage body. In this way the coupling spring can be integrated with little space requirement into the carriage body and can be coupled with the carriage body. Hence, the carriage, i.e. the joint bolt and the coupling spring can easily be coupled with the guide lever.

The guide carriage is turned when traversing the terminal channel section, the coupling spring is tensioned accordingly and a force or a torque is applied to the guide lever. By the torque the second end piece of the guide lever, which is connected to the guide fitting, is turned against the wardrobe and the sliding door is drawn forcefully against the frame of the furniture opening, which is therefore tightly closed.

Preferably, the guide lever is curved with the first end piece of the guide lever extending towards the opening direction of the sliding door, i.e. in the same direction, in which the guide channel extends in the terminal channel section. The guide lever is for example L-shaped or crescent-shaped. In the end position of the carriage and with the first sliding door fully opened, due to its curvature, the guide lever can encompass the edge of the neighbouring second sliding door and can hold the first sliding door in front of the second sliding door.

The form of the terminal channel section of the guide channel is preferably selected such that the guide carriage, while traversing the terminal channel section, is turned by an angle, which is preferably in the range of 65°-180°. E.g., the terminal channel section extends at least approximately along one or two quadrants of a circle. The curve can also exhibit a spiral shape with a continuously declining curve radius. The curve radius can decline linearly or non-linearly, optionally logarithmically, along the terminal channel section. The curve radius can also decline in a first curve area linearly and in a second curve area non-linearly. The form is selected such that a desired turning of the guide carriage and therefore a desired tension of the coupling spring results.

The guide channel can consist of a unitary guide rail that is curved accordingly within the terminal channel section. This however requires considerable efforts if the size of the cross-section of the guide channel shall be maintained constant when the guide rail is bent.

Preferably a straight guide rail is used, which is adjoined by a curved rail element that preferably is embedded in a guide plate. The terminal channel section of the guide channel can advantageously be embossed into the guide plate. Alternatively, the guide plate is moulded from metal or plastic. Hence, by using a straight guide rail and a guide plate with a curved rail element the guide channel can advantageously be created with a constant channel cross-section over the entire length.

In a preferred embodiment the sliding door or the guide fitting is provided with a door stop, against which a first lever stop provided at the first end piece of the guide lever is turned when the guide carriage is driven out of the terminal channel section. In a further preferred embodiment the guide carriage comprises a carriage stop, against which the second lever stop provided at the second end piece of the guide lever is turned when the guide carriage is driving out of the terminal channel section. The carriage stop can simply be provided by the carriage body itself. Preferably both embodiments, the door stop, the carriage stop as well as the first and second lever stop are provided in combination, so that the turning range of the guide lever is limited during the drive parallel to the front side of the wardrobe on the one hand relative to the sliding door or the guide fitting and on the other hand relative to the carriage.

The door stop and the first lever stop on the one hand and/or the carriage stop and the second lever stop on the other hand are preferably provided such that after entry of the guide carriage into a part of the guide channel, which runs in parallel to the front side of the wardrobe, or after the entry of the guide carriage into the straight guide rail the door stop abuts preferably without play the first lever stop and the carriage stop abuts preferably without play the second lever stop. A turn of the guide lever into one direction is therefore limited by the door stop and a turn of the guide lever into the other direction is limited by the carriage stop. Hence, in this position of the guide lever, the sliding door is guided in parallel to the front side of the wardrobe without displacements perpendicular to the running direction and corresponding vibrations.

In a preferred embodiment the door stop and the first lever stop and/or the carriage stop and the second lever stop each are elastically held or made elastically or are contacted via an elastic element. In this way noise is avoided when said end stops meet. Furthermore, in the event that larger manufacturing tolerances occur it is still guaranteed that the sliding door is guided without play.

In a further preferred embodiment the guide carriage comprises at least one bearing roller which is seated on a runway that extends in parallel to the guide channel and that is preferably a unitary part of the guide rail and/or the guide plate. This guide carriage allows supporting the load of the sliding door or a part thereof and guiding the sliding door along the guide channel, i.e. along the guide channel and support channel or runway.

However, if the guide carriage primarily serves for guiding the sliding door and for this purpose for example is engaged from below in the guide channel, then the bearing roller ensures that the guide roller always remains engaged in the guide channel. This allows using a guide channel with channel walls that have a minimum height as required by the guide rollers and therefore requiring little space.

The guide rollers are held by first bearing shafts that preferably extend at least approximately vertically aligned from above or below into the guide channel. The at least one bearing roller however is held by a second bearing shaft, which is at least approximately horizontally aligned.

The inventive guide carriage with at least two guide rollers or with at least two guide rollers and at least one bearing roller fulfils several functions. Equipped with a coupling spring, besides the guide function or the guide function and the support function, a closing function is implemented in addition. With the closing function a closing force can automatically be applied to the sliding door, with which the sliding door can be moved into a desired direction, particularly a direction perpendicular to the front side of the wardrobe.

With the inventive guiding device and the inventive guide carriage wardrobes with sliding doors can advantageously be improved. The sliding doors held by the guiding device are precisely and stably guided and stably held in each position, particularly in the terminal positions. The sliding doors can completely be moved away from the openings of the wardrobe. The closing function is further improved such that wardrobe openings with maximum size can reliably be closed.

The guiding device can be arranged at the upper side or the lower side of the wardrobe. Furthermore, a guiding device can be provided at the upper side and the lower side each of the sliding door. If the guiding device is provided at the upper side or lower side of the wardrobe only, then a complementary guiding and support device is provided at the lower side or the upper side of the wardrobe. If the complementary guiding and support device completely fulfils the support function, then the inventive guiding device can provide the guide function only. As mentioned, also in this case using at least one bearing roller is beneficial.

Inventive pieces of furniture comprise at least one sliding door which can be offset and laterally moved in front of a neighbouring separation element, such as a neighbouring sliding door or a fixed panel. A symmetrical setup with two sliding doors is however preferred.

BRIEF DESCRIPTION OF THE DRAWINGS

The invention is described below with reference to the drawings. Shown are:

FIG. 1*a* shows an inventive wardrobe 9 with a cover plate 93 and side plates 94 and with two sliding doors 91, 92 that are held each by an inventive guiding device 6 and that serve each for closing a furniture opening 90 (see FIG. 1*b*). A force vector F1 illustrates that the first sliding door 91 is pulled by the guiding device 6 against the frame of the furniture opening 90. The function of the guiding device 6, which is connected to the second sliding door 92, is identical, wherefore only the guiding device 6 is described that is connected to the first sliding door 91.

FIG. 1*b* shows the wardrobe 9 of FIG. 1*a* after the first sliding door 91 has been offset or moved forward from the related furniture opening 90 and has been shifted aside laterally in parallel to a position in front of the second sliding door 92 by means of the related guiding device 6. The guiding device 6 comprises a guide carriage 62 that is guided along a guide rail 68 up to an intermediate wall plate 95 and that is connected via a curved guide lever 63 to the first sliding door 91. The first sliding door 91 is held by the guiding device 6 when moving in parallel to the front of the wardrobe 9 such that the first sliding door 91 cannot be displaced perpendicular to the running direction. When trying to displace the sliding door 91 perpendicular to the running direction in the one or the other direction a corresponding counterforce F2 or F3 is applied by the guiding device 6.

FIG. 1*b* shows further that the first sliding door 91 held by the curved guide lever 63 has been shifted completely to a position in front of the second sliding door 92 and is coaxially aligned to the second sliding door 92 in this position. Hence, the furniture opening 90, which comprises a maximum size, has been opened to completely. The curved guide lever 63 encompasses the second sliding door 92 and can therefore hold the first sliding door 91 outside of the range of the related furniture opening 90.

FIG. 2*a* shows the wardrobe 9 with the guiding device 6 in the configuration of FIG. 1*a* after the removal of the first sliding door 91 and a sidewall 94 and with a cut through the centre of the cover plate 93. The guiding device 6 comprises the straight guide rail 68, which adjoins a guide plate 69, into which the carriage 62 has been driven. The carriage 62 is connected to a first end piece of the curved guide lever 63, whose second end piece is connected to a guide fitting 61, from which the first sliding door 91 has been released. On the lower side of the wardrobe 9 a complementary guiding- and holding device 1 is provided, which comprises a complementary carriage 11 and complementary fittings 10 connected thereto. The complementary carriage 11 is shiftable along a curved track such that the complementary fitting 10 is moving in parallel to the guide fitting 61 when the sliding door 91 is displaced. The complementary guiding- and holding device 1 also allows fully supporting the sliding door 91, wherefore the guiding device 6 in this embodiment is not exposed to the gravitational force of the sliding door 91.

FIG. 2*b* shows the wardrobe 9 in the configuration of FIG. 1*b* after the removal of the first sliding door 91 and with a cut through the center of the cover plate 93. The guide fitting 61 and the complementary fitting 10 have been moved along identical curves k in parallel to one another. In its terminal position the guide carriage 62 is within the furniture opening 90 close to the intermediate wall 95, whereby the guide fitting 61 is held by the guide lever 63 in front of the second sliding door 92.

FIG. 3*a* shows the guiding device 6 in the configuration of FIG. 2*a* with the guide plate 69 comprising a rail element 690 that adjoins the guide rail 68. The guide rail 68 and the rail element 690 form a guide channel 60 (see FIG. 3*c*), in which the guide carriage 62 is displaceably held. The guide carriage 62 is pivotally connected via the approximately L-shaped guide lever 63 to the guide fitting 61, from which the first sliding door 91 has been released. By means of a first lever joint, i.e. by a first joint bolt 613, a first end piece 63A of the guide lever 63 is pivotally connected to the guide fitting 61. The guide plate 69 is provided with mounting bores 697 through which mounting screws 699 can be inserted into the cover plate 93.

FIG. 3*b* shows the guide carriage 62, the guide lever 63 and the guide fitting 61, which have been removed from the guiding device of FIG. 3*a* without changing their mutual positions. The guide carriage 62 comprises a carriage body 621 with two vertically aligned bearing shafts 626, which rotatably hold guide rollers 622. The carriage body 621 is pivotally connected by a second pivot joint, i.e. by a second joint bolt 623, to a second end piece 63B of the guide lever 63. Hence, the guide fitting 61 and the guide carriage 62 are turnable around parallel pivot axes approximately in a plane each up to an end stop.

FIG. 3*b* shows that the guide carriage 62, i.e. the carriage stop formed by the carriage body 621 is turnable against a second lever stop 632 that is formed by an angular element provided at the second end piece 63B of the guide lever 63. FIG. 3*d* shows that a first lever stop 631, which is provided at the first end piece 63A of the guide lever 63, is turnable against a door stop 611, which is provided as an angular element at the guide fitting 61. Schematically shown are elastic elements 6351, 6352, which are optionally insertable between the door stop 611 and the first lever stop 631 and between the carriage stop 621 and the second lever stop 632. Elastic elements 6351, 6352, such as leaf springs or elastic plastic or natural rubber, allow mechanical and acoustical damping of the impact of the first and of the second lever stops 631, 632 on the door stop 611 or the carriage stop 621, respectively, and to hold those elements without play.

FIG. 3*c* shows the guiding device 6 of FIG. 3*a* from below with a view into the guide rail 68 and into the rail element 690 provided in the guide plate 69, which form a guide channel 60. The guide channel 60 extends along the guide rail 68 and the rail element 690 of the guide plate 69, which at first extends along an extended 90° curve that is adjoined at the end by a further smaller curve of almost 90°. This course of the curve forms the terminal channel section 600 of the guide channel 60. The guide carriage 62 has been driven along this terminal channel section 600 into the furniture opening 90 and has been turned thereby by approximately 135°. By turning the guide carriage 62, which is connected by a coupling spring 65 to the guide lever 63 (see FIG. 4) a force or a torque is applied to the guide lever 63 so that the guide lever 63 is further turned until the sliding door 91 is firmly pressed against the frame of the furniture opening 90.

FIG. 3*d* shows the guide carriage 62, the guide lever 63 and the guide fitting 61 of FIG. 3*b* from below.

FIG. 4 shows the guide carriage 62, the guide lever 63 and the guide fitting 61 of FIG. 3*b* in explosion view. The individually shown guide lever 63 is approximately L-shaped or crescent-shaped and comprises at the first end piece 63A the first lever stop 631 as well as a first joint opening 6301, into which the first joint bolt 613 is insertable that can be guided through an opening 610 in the guide fitting 61. The guide fitting 61 comprises an angular shape with a first bracket forming a fitting plate 617 that comprises mounting openings 6171 and that is connectable to the sliding door 91. The second bracket of the fitting plate 617 comprises two openings 610, in one of which selectively the joint bolt 613 can be inserted. In the guide fitting 61 of the first sliding door 91 the joint bolt 613 is inserted into the right-sided opening 610 and in the guide fitting 61 the second sliding door 92 the joint bolt is inserted into the left-sided opening 610. Hence, the same guiding device 6 can be assembled such that it can be mounted on the one or other side of the wardrobe 9 for each of the sliding doors 91, 92.

Figure 1B:
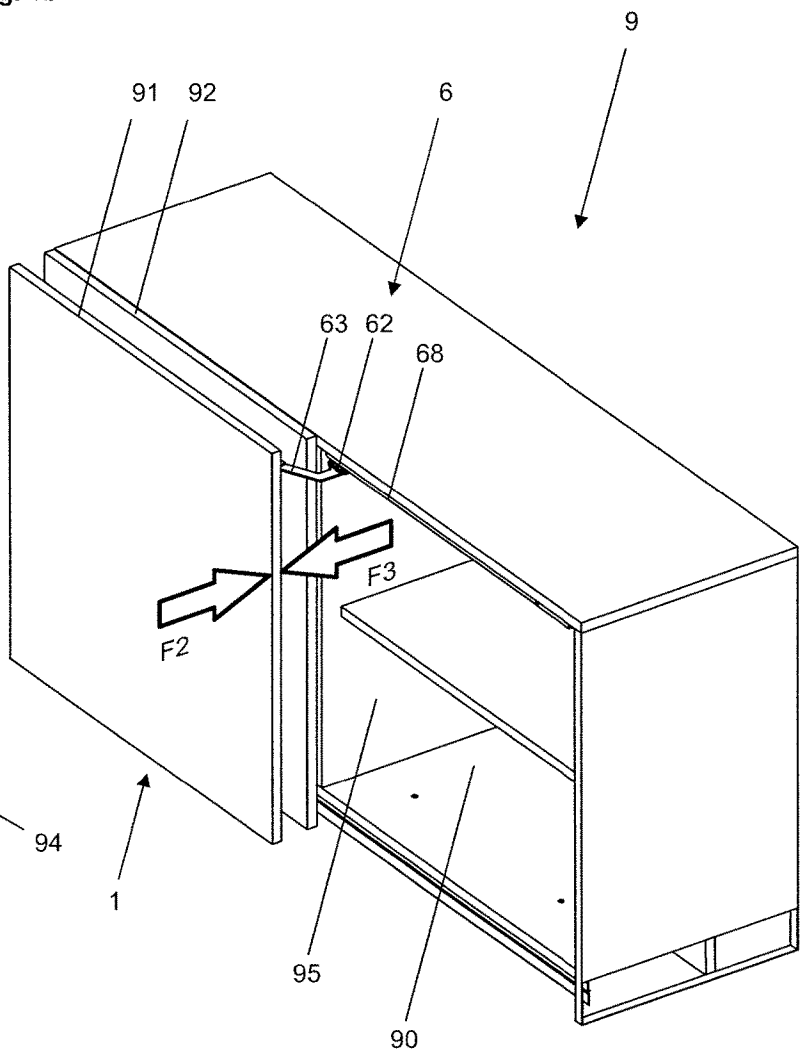
FIG. 1*b* the wardrobe 9 of FIG. 1*a* after the first sliding door 91 has been moved by means of the related guiding device 6 to a position in front of the second sliding door 92.

At the second end piece 63B the guide lever 63 comprises the second lever stop 632 and a second joint opening 6302, into which the second joint bolt 623 is insertable, which is held in the carriage body 621 of the guide carriage 62 in a bearing cylinder 6211. Concentrically to the bearing cylinder 6211 the carriage body 621 comprises an annular receiving opening 6210, into which the coupling spring 65 is insertable, which comprises a coil unit 651 with two end pieces 651 and 652. The first end piece of the spring 652 is insertable into a coupling opening 6215 provided in the carriage body 610 (see FIG. 7*b*). The second end piece of the spring 653 is insertable into a spring opening 6305 provided in the second end piece 63B of the guide lever 63. Hence, the guide carriage 62 is connected to the guide lever 63 on the one hand via the second joint bolt 623 and on the other hand via the coupling spring 65. By turning the guide carriage 62 (to the right side) the coupling spring 65 is tensioned and a torque is applied to the guide lever 63.

Figure 1A:
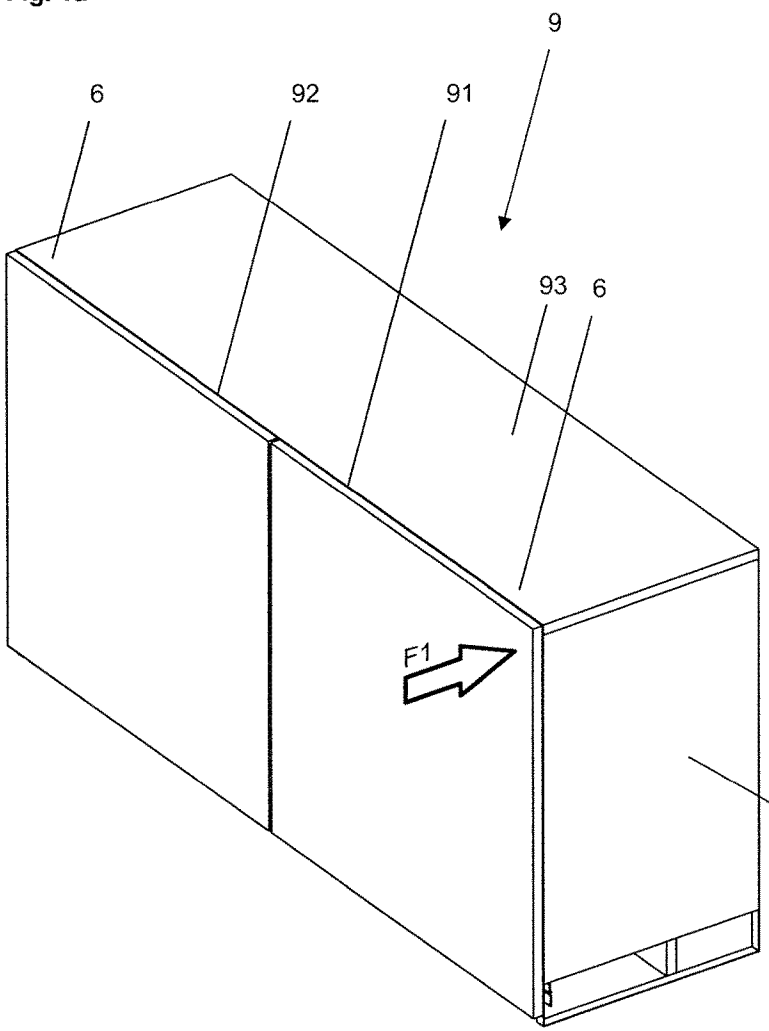
FIG. 1*a* an inventive wardrobe 9 with two sliding doors 91, 92 that are held each by an inventive guiding device 6, that serve for closing related furniture openings and that can be offset from the furniture opening and can laterally be moved.
Figure 2B:
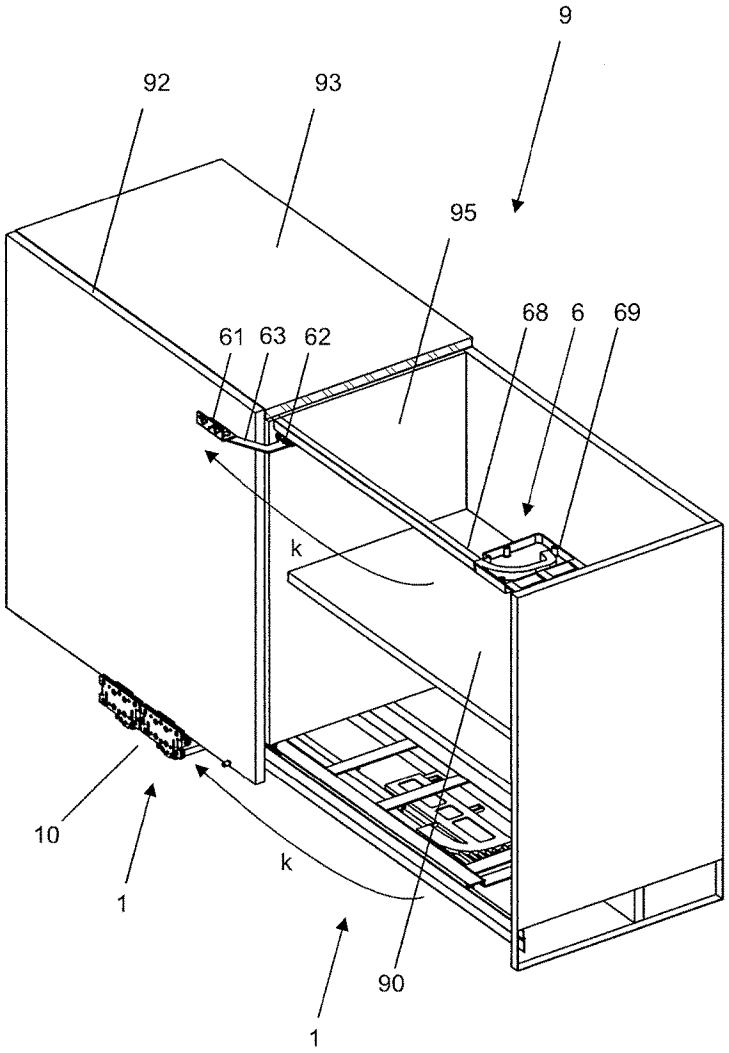
FIG. 2*b* the wardrobe 9 in the configuration of FIG. 1*b* after removal of the first sliding door 91 and with a cut through the centre of the cover plate 93.
Figure 2A:
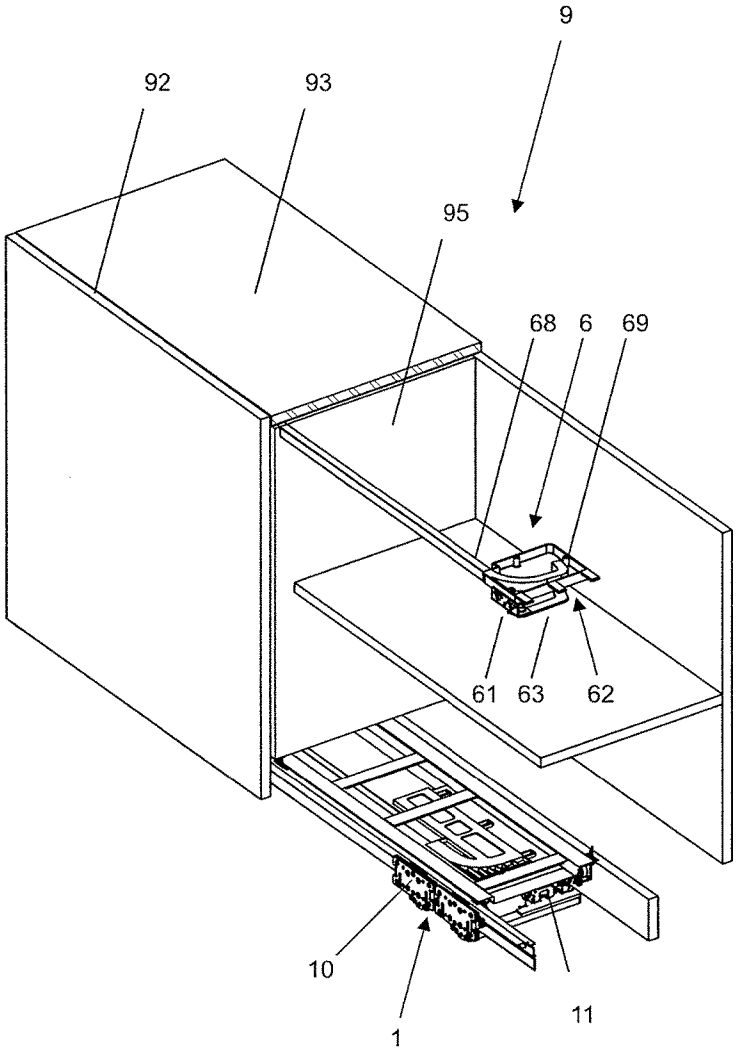
FIG. 2*a* the wardrobe 9 in the configuration of FIG. 1*a* after removal of the first sliding door 91 and a sidewall 94 and with a cut through the centre of the cover plate 93.
Figure 3C:
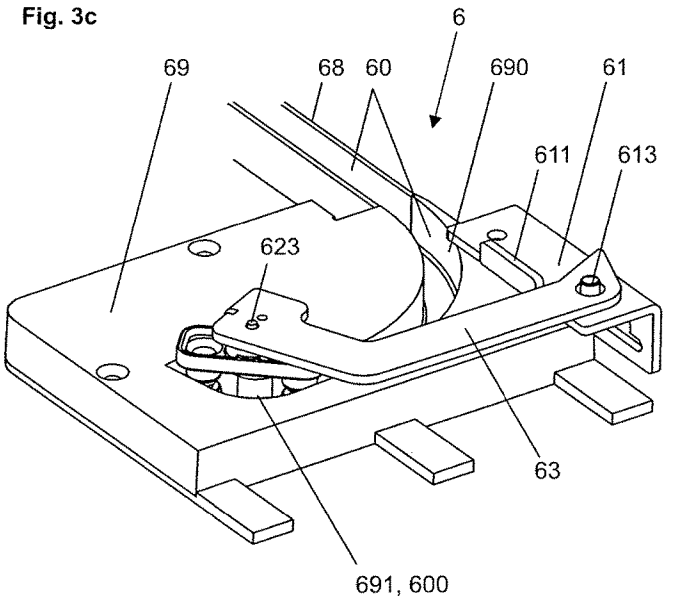
FIG. 3*c* the guiding device 6 of FIG. 3*a* from below.
Figure 3A:
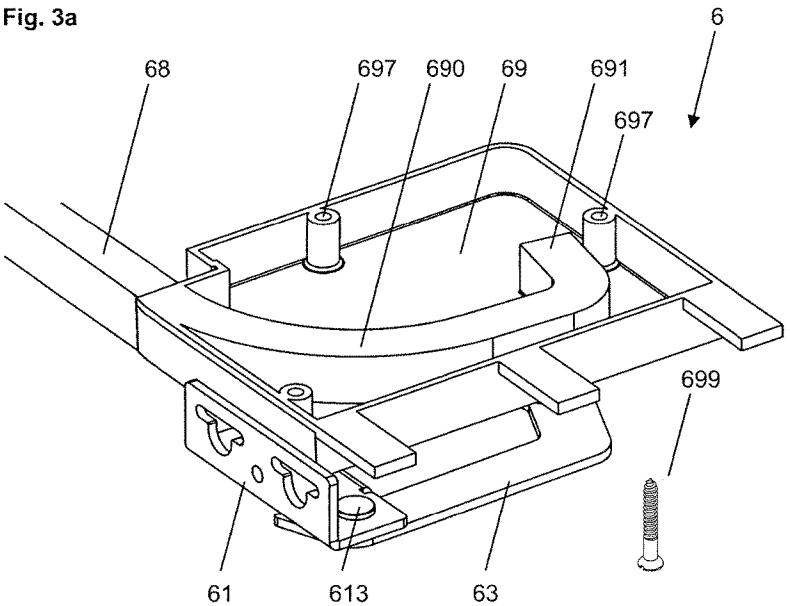
FIG. 3*a* the guiding device 6 in the configuration of FIG. 2*a* that comprises a guide plate 69 with a rail element 690 that adjoins a guide rail 68, in which a guide carriage 62 is displaceable that is pivotally connected via a guide lever 63 to a guide fitting 61 that has been released from the first sliding door 91.
Figure 3D:
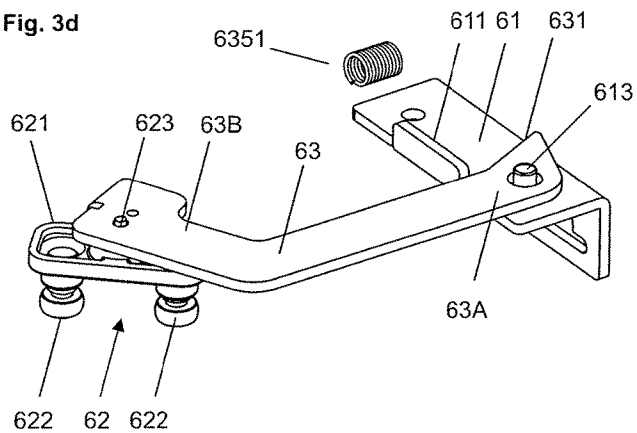
FIG. 3*d* the guide carriage 62, the guide lever 63 and the guide fitting 61, which have been removed from the guiding device of FIG. 3*c* without changing their mutual position.
Figure 3B:
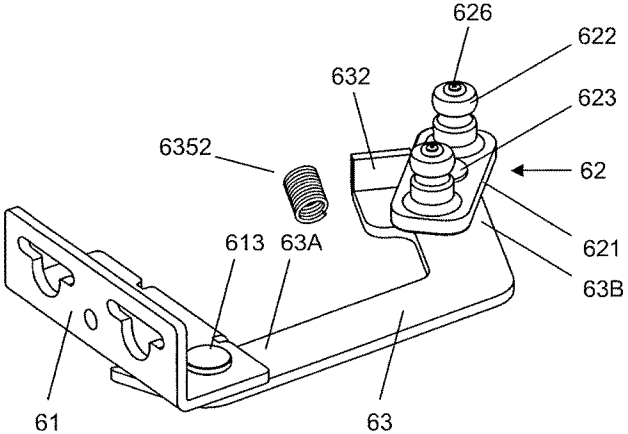
FIG. 3*b* the guide carriage 62, the guide lever 63 and the guide fitting 61, which have been removed from the guiding device of FIG. 3*a* without changing their mutual position.
Figure 4:
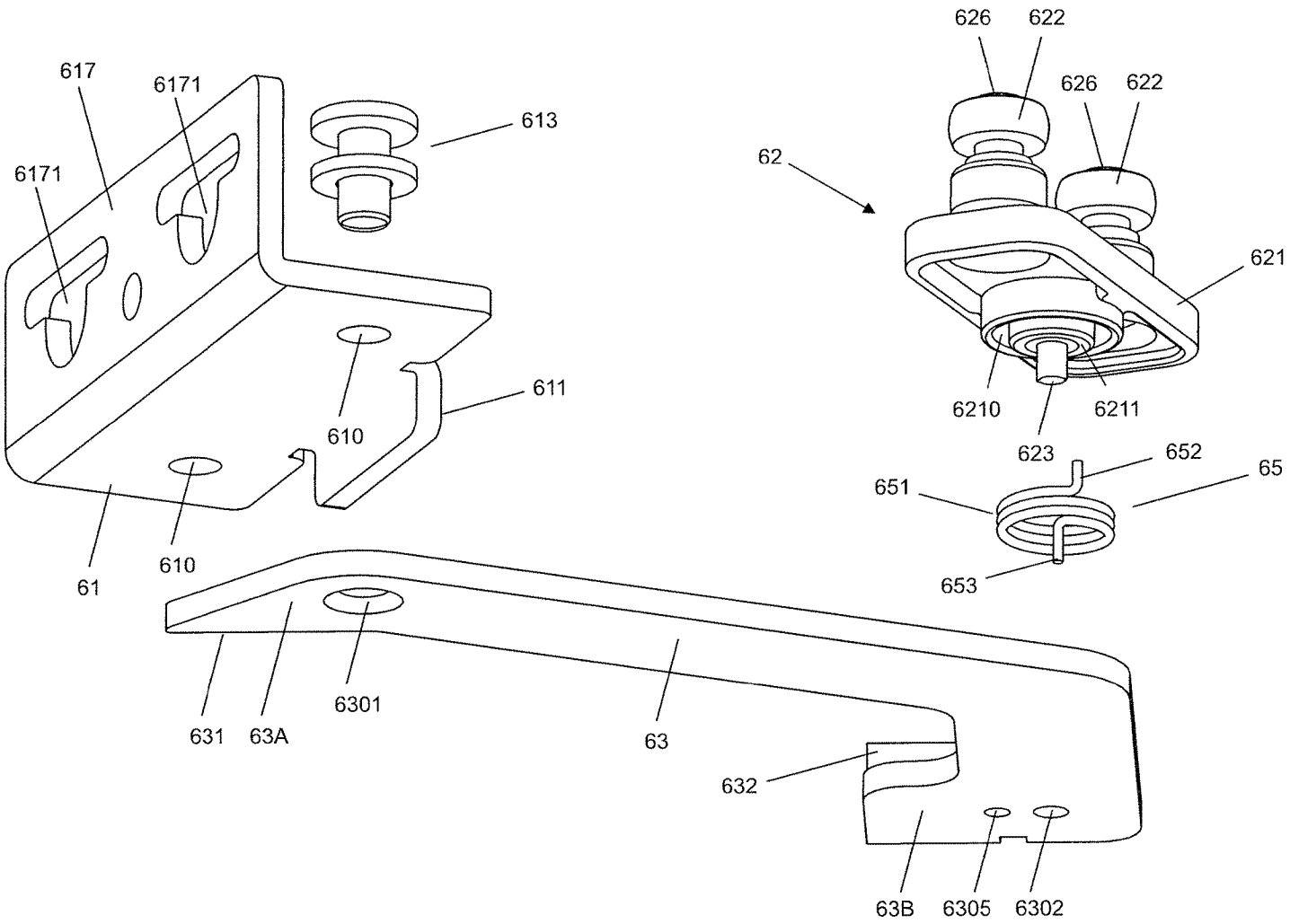
FIG. 4 the guide carriage 62, the guide lever 63 and the guide fitting 61 of FIG. 3*b* in explosion view with a coupling spring 65 that has been removed from the guide carriage 62 and that on one side is connectable to the carriage body 621 of the guide carriage 62 and that is connectable on the other side to the guide lever 63.
Figure 5B:
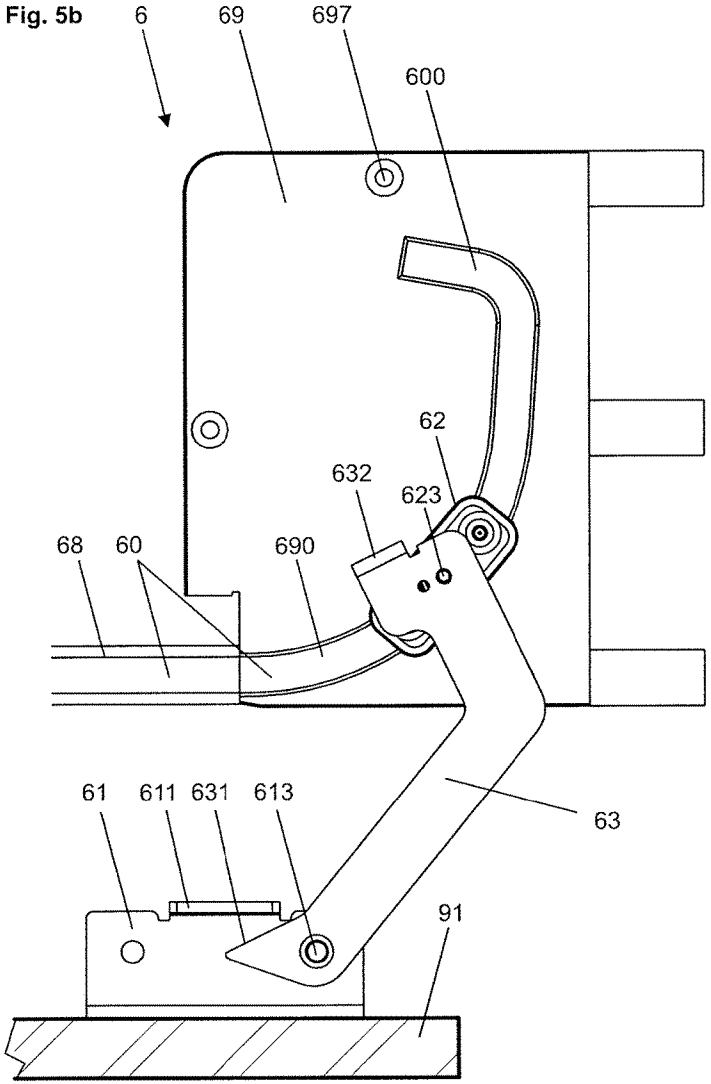
FIG. 5*b* the guiding device 6 of FIG. 5*a* during the process of opening the sliding door 91 and shortly before the exit of the guide carriage 62 at the guide plate 69 and the entry into the guide rail 68.
Figure 5A:
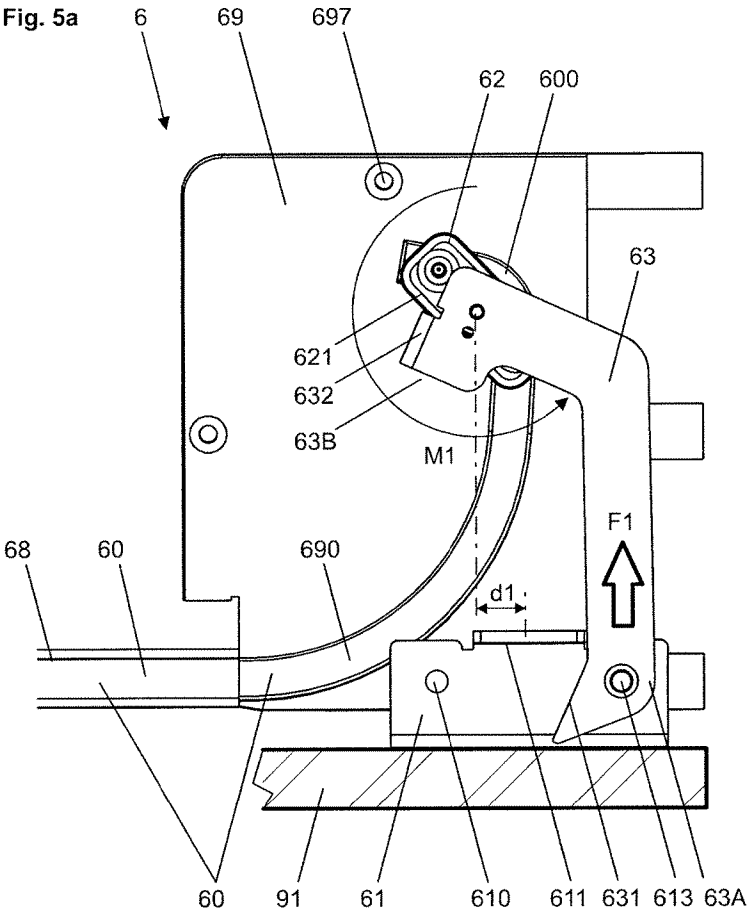
FIG. 5*a* the guiding device 6 in the configuration of the wardrobe 9 of FIG. 1*a* seen from below.

FIG. 5*a* shows the guiding device 6 in the configuration of the wardrobe 9 of FIG. 1*a* from below with the sliding door 91 connected to the guide fitting 61 in the terminal position of the guide carriage 62, as shown in FIGS. 3*a*-*d*. The guide lever 63 together with the guide carriage 62 has been driven into the furniture opening 90 and has been turned counter clockwise, whereby the guide fitting 61 has been guided towards the right side of the wardrobe 9. By turning the guide carriage 62 while traversing the terminal channel section 600 of the guide channel 60 the coupling spring 65 has been tensioned, wherefore a corresponding torque M1 is applied to the guide lever 63. The guide lever 63 transfers a corresponding force F1 to the guide fitting 61, with which the sliding door 91 is perpendicularly drawn against the wardrobe 9.

In FIG. 5*a* the distance d1 is drawn, by which the guide fitting 61 has been moved to the right side passed by the guide carriage 62.

FIG. 5*b* shows the guiding device 6 of FIG. 5*a* during the process of opening the sliding door 91 shortly before the exit of the guide carriage 62 out of the guide plate 69 and the entry into the guide rail 68. The sliding door 91 has been offset from the furniture opening 90 and the guide fitting 61 has been moved passed by the guide carriage 62 to the left.

Figure 5C:
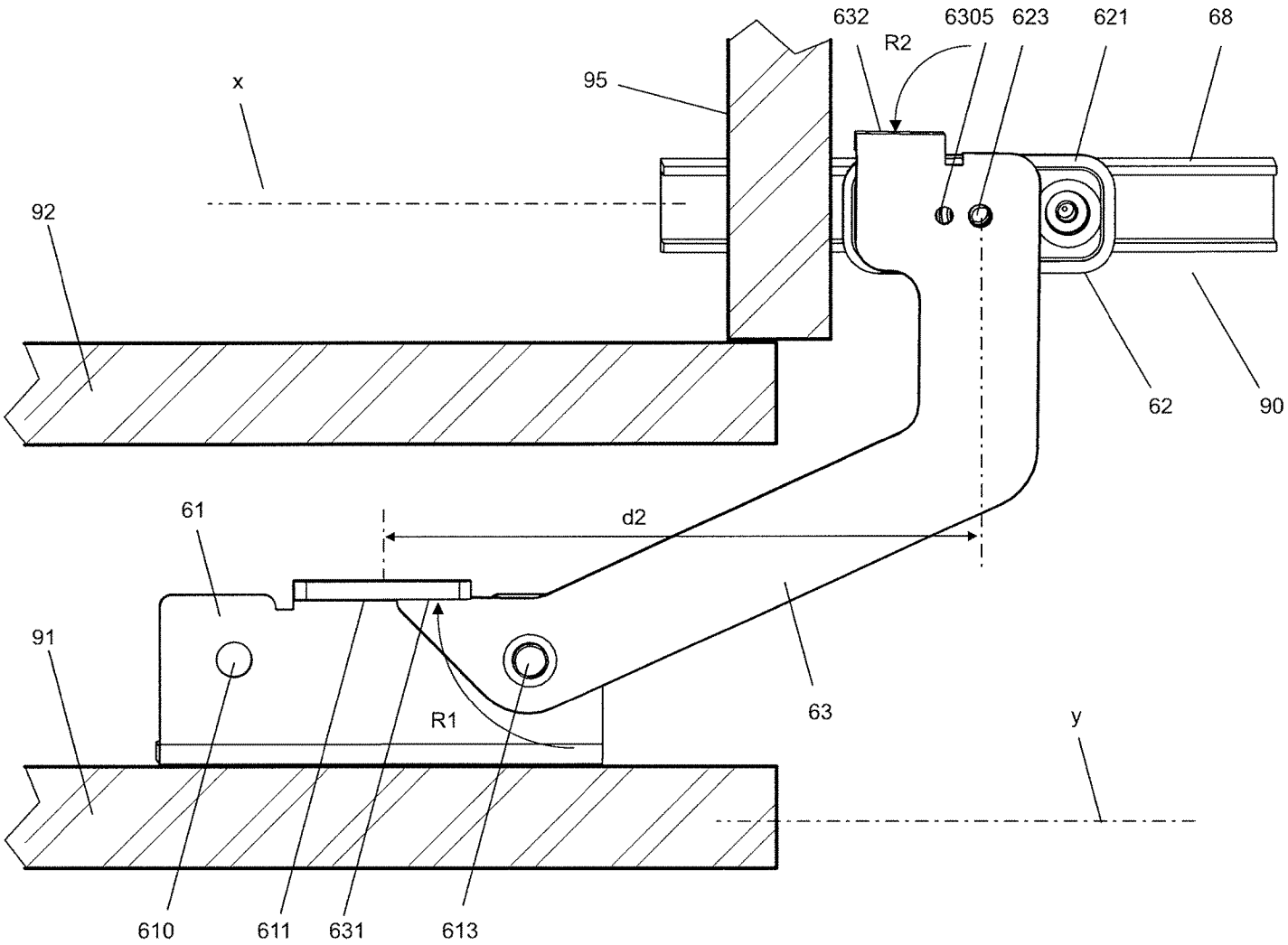
FIG. 5*c* the guiding device 6 of FIG. 5*b* after entry of the guide carriage 62 into the guide rail 68.

FIG. 5*c* shows the guiding device 6 of FIG. 5*b* after the entry of the guide carriage 62 into the guide rail 68 (only partly shown) and the displacement up to the terminal stop at the intermediate wall 95. The first sliding door 91 has completely been moved away from the related furniture opening 90 and has been shifted to a position in front of the second sliding door 92. By the curved guide lever 63 the guide fitting 61 is held by a distance d2 ahead of the guide carriage 62. Hence, by the displacement of the first sliding door 91 the guide fitting 61 has traversed an additional distance d=d1+d2 in parallel to the guide rail 68, compared to the guide carriage 62.

After the entry into the guide rail 68 the guide carriage 62 is aligned in parallel to the longitudinal axis x of the guide rail 68. The second lever stop 632 abuts the carriage stop or the carriage body 621 and cannot be turned further left into the direction R2 shown by the arrow. The first lever stop 631 abuts at the same time the door stop 611 and cannot be further turned in the opposite direction to the right shown by arrow R1. Hence, the guide lever 63 is held torque proof by the door stop 611 and the carriage stop 621 in both directions R1 and R2. The sliding door 91 can only be displaced axially along a shift axis y which extends parallel to the longitudinal axis x of the guide rail 68. Displacements perpendicular to the shift axis y as well as corresponding vibrations noise are avoided.

Figure 6:
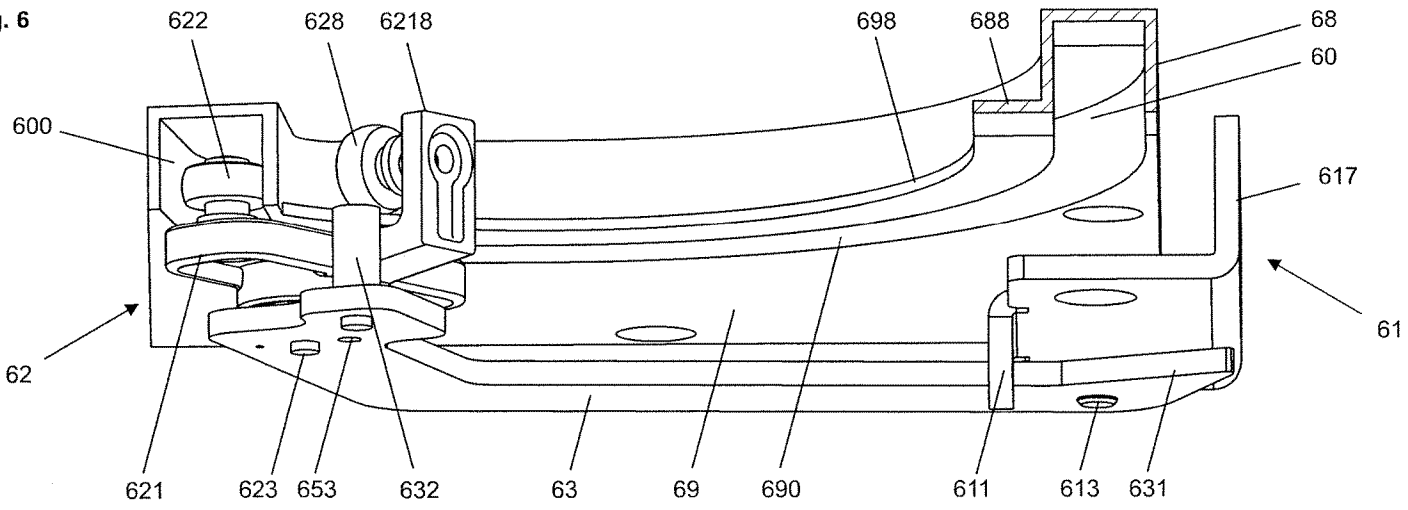
FIG. 6 a guiding device 6 in a preferred embodiment with a guide carriage 62 that comprises two guide rollers 622 guided in a guide rail 68 and one support wheel 628, that rolls along a horizontally aligned runway 688, 698 of the guide rail 68 and the guide plate 69.

FIG. 6 shows the guiding device 6 in a preferred embodiment from below with a view approximately along the longitudinal axis x of the guide rail 68. In this embodiment the guide carriage 62 is provided with a support wheel 628 that is seated on a horizontally aligned runway 688, 698 which extends along the guide rail 68 and the guide plate 69 in parallel to the guide channel 60. The carriage body 621 comprises an additional holding member 6218 which holds a second bearing shaft 627, with which the support wheel 628 is rotatably held (see also FIG. 7*a*). By the support wheel 628 the guide carriage 62 is always held on the same height, wherefore stable engagement of the guide rollers 622 into the guide channel 60 is ensured. Hence, it is possible to use a guide channel 60 or a guide rail 68 and a rail element 690 that exhibit a small wall height. In addition the guide carriage 62 can support the load of the sliding door 91 or a part thereof.

FIG. 6 further shows that in this embodiment the second lever stop 632 is not a unitary part of the guide lever 63. Instead a cylindrical lever stop 632 is connected to the guide lever 63 by a rivet. The cylindrical lever stop 632 is preferably made from elastic material, so that a play free connection is reached and noise is avoided when the guiding device 6 is operated. Hence, the door stop 611 as well as the first and the second lever stop 631, 632 can be a unitary part of the guide lever 63 can be separate items.

Figure 7B:
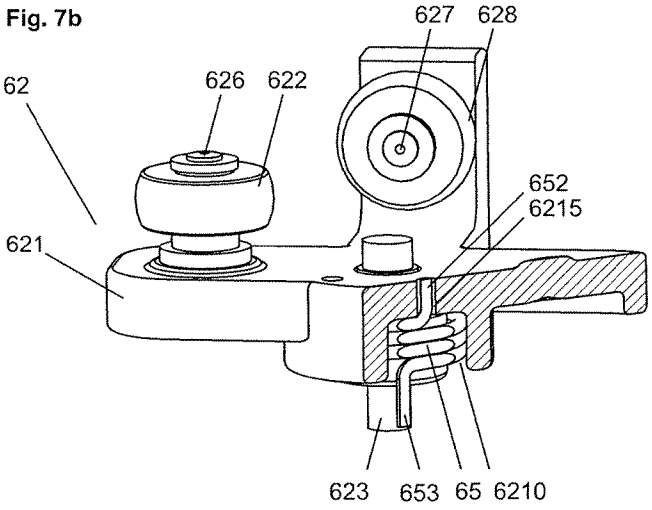
FIG. 7*b* the guide carriage 62 of FIG. 7*a* with a cut along line A-A.
Figure 7A:
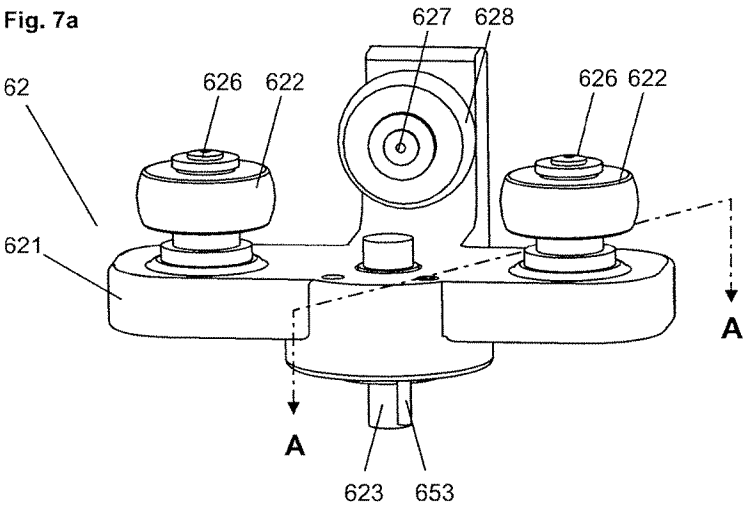
FIG. 7*a* the guide carriage 62 removed from the guiding device 6 of FIG. 6.

FIG. 7*a* shows the guide carriage 62, which has been removed from the guiding device 6 of FIG. 6 and which comprises two guide rollers 622 and a bearing roller 628, which are held by first and second bearing shafts 626, 627.

FIG. 7*b* shows the guide carriage 62 of FIG. 7*a* with a cut along line through the receiving opening 6210 provided for the coupling spring 65 and through the coupling opening 6215, in which the first end piece of the spring 652 is anchored. The second end piece of the spring 653 extends as well as the second joint bolt 623 out of the receiving opening 6210.

The guiding device 6 can further be developed so that individual device parts, particularly the carriage stop 621, the door stop 611, the first lever stop 631 and/or the second lever stop 632 can be adjusted, so that the ranges, in which the guide fitting 61 can be turned against the guide lever 63 and the guide carriage 62 against the guide lever 63, can be adjusted. It can also be provided that the bearing shaft 627, which holds the support wheel 628, can be shifted in height. E.g., the bearing shaft 627 may be seated in a sledge, which can be moved along the holding member 6218.

LITERATURVERZEICHNIS

[1] US2014/150208A1
[2] U.S. Pat. No. 8,763,205 B2

LIST OF REFERENCES

1 complementary guiding device
10 complementary fitting
11 complementary carriage
6 guiding device
60 guide channel
600 terminal channel section of the guide channel
61 guide fitting
610 openings for receiving the first joint bolt 613
611 door stop
613 first lever joint, first joint bolt
617 fitting plate
6171 mounting openings in the fitting plate 617
62 guide carriage
621 carriage body, carriage stop
6210 receiving openings, recess
6211 bearing cylinder
6215 coupling opening
6218 holding member
622 guide rollers
623 second lever joint, second joint bolt
626 first bearing shaft
627 second bearing shaft
628 bearing roller
63 guide lever
63A first end piece of the guide lever 63
63B second end piece of the guide lever 63
6301 first joint opening
6302 second joint opening
6305 spring opening
631 first lever stop
632 second lever stop
65 coupling spring
651 coil unit
652 first end piece of the spring
653 second end piece of the spring
68 guide rail
688 runway at the guide rail 68
689 guide channel
69 guide plate
690 rail element in the guide plate 69
697 mounting bores provided in the guide plate 69
698 runways at the guide plate 69
699 mounting screws
9 piece of furniture, particularly wardrobe
90 furniture opening
93 cover plate
94 side wall
95 intermediate wall
91, 92 sliding doors
k transportation path

The invention claimed is:

1. A guiding device for holding and guiding a sliding door, with which a furniture opening of a piece of furniture can be closed, comprising a guide fitting that is connectable to the sliding door and that is connected via a first articulated joint to a first end piece of a guide lever, and a guide carriage comprising a carriage body that holds two guide rollers arranged in running direction behind one another and are guided in a guide channel that extends at least on one side in a terminal channel section along a curve into the furniture opening, a second end piece of the guide lever being connected via a second articulated joint to the guide carriage, wherein the guide lever is curved such that the guide fitting is held offset from the guide channel and is ahead of the guide carriage in an opening direction and during the opening process of the sliding door;

the carriage body is connected by a coupling spring to the second end piece of the guide lever; and the guide carriage is turned when traversing the terminal channel section, so that the coupling spring is tensioned and executes a force or a torque onto the guide lever.

2. The guiding device according to claim 1, wherein the form of the terminal channel section is selected such that the guide carriage, when traversing the terminal channel section, is turned by an angle in the range of 65°-180°.

3. The guiding device according to claim 2, wherein the guide lever is L-shaped or crescent-shaped.

4. The guiding device according to claim 1, wherein the guide lever is L-shaped or crescent-shaped.

5. The guiding device according to claim 1, wherein the guide channel is formed by a guide rail and a rail element, and the rail element adjoins the guide rail and is part of a guide plate.

6. The guiding device according to claim 1, wherein the coupling spring is a spiral spring or a cylindrical coil spring that is arranged in a recess provided in the carriage body and that is anchored with a first end piece in the carriage body and with the second end piece in the guide lever.

7. The guiding device according to claim 1, wherein the sliding door or the guide fitting are provided with a door stop, against which a first lever stop is turnable when the guide carriage is moving out of the terminal channel section and/or the guide carriage comprises a carriage stop which is optionally provided by the carriage body and against which a second lever stop is turnable when the guide carriage is moving out of the terminal channel section.

8. The guiding device according to claim 7, wherein the door stop abuts the first lever stop and/or the carriage stop abuts the second lever stop when the guide carriage is moving in a section of the guide channel that runs in parallel to the front of the piece of furniture.

9. The guiding device according to claim 8, wherein the door stop and the first lever stop and/or the carriage stop and the second lever stop are elastically supported or are connectable with one another via an elastic element.

10. The guiding device according to claim 7, wherein the door stop and the first lever stop and/or the carriage stop and the second lever stop are elastically supported or are connectable with one another via an elastic element.

11. The guiding device according to claim 1, wherein the guide carriage supports at least one bearing roller that is seated on a runway, which extends in parallel to the guide channel.

12. The guiding device according to claim 11, wherein the guide rollers are held by respective first bearing shafts that extend vertically from above or below into the guide channel, and the at least one bearing roller is held by a second bearing shaft which is aligned perpendicular to the first bearing shafts.

13. A piece of furniture, comprising at least one sliding door that is connected at the lower side and/or at the upper side to the guiding device according to claim 1.

14. The piece of furniture according to claim 13, wherein at the lower side and/or at the upper side of the piece of furniture the guide channel with the terminal channel section, which extends along the curve, is provided, in which the guide rollers of the guide carriage are guided.

15. The piece of furniture according to claim 14, wherein the guide carriage comprises at least one bearing roller that is seated on a runway extending in parallel to the guide channel and which carries the load of the sliding door or a part thereof.

16. The piece of furniture according to claim 13, wherein the guide carriage comprises at least one bearing roller that is seated on a runway extending in parallel to the guide channel and which carries the load of the sliding door or a part thereof.

* * * * *